US010982376B2

(12) United States Patent
Leibman et al.

(10) Patent No.: US 10,982,376 B2
(45) Date of Patent: Apr. 20, 2021

(54) WASHING MACHINE APPLIANCE AND EXTENDABLE NOZZLE THEREFOR

(71) Applicant: Haier US Appliance Solutions, Inc., Wilmington, DE (US)

(72) Inventors: Alexander B. Leibman, Prospect, KY (US); Wayne E. Lawson, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 143 days.

(21) Appl. No.: 16/248,880

(22) Filed: Jan. 16, 2019

(65) Prior Publication Data

US 2020/0224357 A1 Jul. 16, 2020

(51) Int. Cl.
*D06F 39/08* (2006.01)
*D06F 39/14* (2006.01)

(52) U.S. Cl.
CPC ..... *D06F 39/088* (2013.01); *D06F 39/14* (2013.01)

(58) Field of Classification Search
CPC ..... D06F 39/088; D06F 39/14
See application file for complete search history.

(56) References Cited

U.S. PATENT DOCUMENTS

| | | | | |
|---|---|---|---|---|
| 2,854,680 | A | 10/1958 | Wilson | |
| 3,908,907 | A | 9/1975 | Automaq | |
| 4,351,132 | A | 9/1982 | Molin | |
| 4,784,166 | A | 11/1988 | Brager | |
| 4,838,302 | A | 6/1989 | Prange | |
| 5,188,134 | A | 2/1993 | Satoh et al. | |
| 5,356,480 | A | 10/1994 | Melgeorge | |
| 6,481,448 | B2 | 11/2002 | Mathieu | |
| 6,886,371 | B2 | 5/2005 | Arai et al. | |
| 8,549,887 | B2 | 10/2013 | Reid et al. | |
| 9,199,262 | B2 | 12/2015 | Bartelick | |
| 2006/0156763 | A1 | 7/2006 | Vecchi et al. | |
| 2009/0235697 | A1* | 9/2009 | Reid | D06F 35/00 68/3 SS |
| 2015/0252518 | A1* | 9/2015 | Fung | D06F 87/00 68/5 C |

(Continued)

FOREIGN PATENT DOCUMENTS

| | | | |
|---|---|---|---|
| CN | 2344103 | Y | 10/1999 |
| CN | 201552148 | U | 8/2010 |

(Continued)

*Primary Examiner* — Spencer E Bell
*Assistant Examiner* — Omair Chaudhri
(74) *Attorney, Agent, or Firm* — Dority & Manning, P.A.

(57) ABSTRACT

A washing machine appliance is provided herein. The washing machine appliance may include a cabinet, a tub, a wash basket, a lid, and a nozzle assembly. The tub may be positioned within the cabinet. The wash basket may be rotatably mounted within the tub and define a wash chamber. The lid may be rotatably mounted to the cabinet above the wash basket. The nozzle assembly may be mounted in part within the lid. The nozzle assembly may include an extendable nozzle and a retractable fluid supply conduit. The extendable nozzle may be movable between a retracted position at which the extendable nozzle is held on the lid and an extended position in which the extendable nozzle is spaced apart from the lid. The retractable fluid supply conduit may be selectively wound on the lid in the retracted position.

15 Claims, 11 Drawing Sheets

(56) References Cited

U.S. PATENT DOCUMENTS

| | | | | |
|---|---|---|---|---|
| 2016/0102425 | A1* | 4/2016 | Scheckelhoff | D06F 29/00 68/13 R |
| 2019/0276975 | A1* | 9/2019 | Leibman | D06F 29/00 |
| 2020/0181828 | A1* | 6/2020 | Carpenter | D06F 29/00 |

FOREIGN PATENT DOCUMENTS

| | | | | |
|---|---|---|---|---|
| CN | 201760419 | U | | 3/2011 |
| CN | 201981587 | U | | 9/2011 |
| CN | 202104868 | U | | 1/2012 |
| CN | 202860887 | U | | 4/2013 |
| CN | 203229271 | U | | 10/2013 |
| CN | 104209290 | A | | 12/2014 |
| CN | 104209291 | A | | 12/2014 |
| JP | H05207956 | A | | 8/1993 |
| JP | 2003081400 | A | | 3/2003 |
| JP | 3555310 | B2 | | 8/2004 |
| JP | 4282294 | B2 | | 6/2009 |
| JP | 2016049156 | A | | 4/2016 |
| JP | 2016049156 | A | * | 4/2016 |
| JP | 6125907 | B2 | | 5/2017 |
| JP | 6177076 | B2 | | 8/2017 |
| KR | 960010174 | Y1 | | 11/1996 |
| KR | 2005081464 | A | | 8/2005 |
| KR | 20050081464 | A | * | 8/2005 |
| KR | 20170099641 | A | * | 9/2017 |

* cited by examiner

WASHING MACHINE APPLIANCE AND EXTENDABLE NOZZLE THEREFOR

FIELD OF THE INVENTION

The present subject matter relates generally to washing machine appliances and more particularly to nozzle assemblies for washing machine appliances.

BACKGROUND OF THE INVENTION

Washing machine appliances generally include a tub for containing water or wash fluid (e.g., water, detergent, bleach, wash additives, etc.). A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

During operation of certain washing machine appliances, a volume of wash fluid is directed into the tub in order to wash or rinse articles within the wash chamber. More specifically, a predetermined volume of wash fluid is typically provided through a stationary nozzle positioned at the center of the back wall of the washing machine appliance. However, in certain situations, a user may wish to have greater control over the wash fluid dispensed into the tub. For instance, a user may wish to add more or less of certain additives (e.g., detergent, bleach, fabric softener, etc.) depending on the particular articles within the tub. Moreover, a user may wish to direct the flow of wash fluid onto a particular garment or within a specific region of the wash tub (e.g., to perform a pretreating operation, to saturate a particular article of clothing, etc.). However, this ability may be limited by the increased complexity and wiring required to relocate existing stationary nozzles. The ability to adjust the amount of wash fluid and its dispensing location is a commercially desirable feature and increases the user's positive perception of the wash process generally.

Accordingly, a washing machine appliance that provides a user with more control over the dispensing of wash fluid is desirable. In particular, a nozzle assembly that enables the dispensing of an additional amount of wash fluid at a desired location within the tub would be particularly beneficial. Additionally or alternatively, it would be advantageous to provide a nozzle assembly that is movable relative to the tub of a washing machine appliance without affecting the usable space of the tub relative to the footprint or volume of the cabinet.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a cabinet, a tub, a wash basket, a lid, and a nozzle assembly. The tub may be positioned within the cabinet. The wash basket may be rotatably mounted within the tub. The wash basket may define a wash chamber for receiving articles for washing. The lid may be rotatably mounted to the cabinet above the wash basket to move between an open position permitting access to the wash chamber and closed position restricting access to the wash chamber. The nozzle assembly may be mounted in part within the lid and configured to provide a liquid to the tub. The nozzle assembly may include an extendable nozzle, and a retractable fluid supply conduit. The extendable nozzle may be movable between a retracted position at which the extendable nozzle is held on the lid and an extended position in which the extendable nozzle is spaced apart from the lid. The retractable fluid supply conduit may be upstream of the extendable nozzle. The retractable fluid supply conduit may be selectively wound on the lid in the retracted position.

In another exemplary aspect of the present disclosure, a washing machine appliance is provided. The washing machine appliance may include a cabinet, a tub, a wash basket, a lid, and a nozzle assembly. The tub may be positioned within the cabinet. The wash basket may be rotatably mounted within the tub. The wash basket may define a wash chamber for receiving articles for washing. The lid may be rotatably mounted to the cabinet above the wash basket to move between an open position permitting access to the wash chamber and closed position restricting access to the wash chamber. The lid may define an enclosed conduit cavity therein. The nozzle assembly may be mounted in part within the lid and configured to provide a liquid to the tub. The nozzle assembly may include an extendable nozzle, a valve assembly, a retractable fluid supply conduit, and a rotatable reel. The extendable nozzle may be movable between a retracted position at which the extendable nozzle is held on the lid and an extended position in which the extendable nozzle is spaced apart from the lid. The valve assembly may be mounted within the cabinet and configured to provide a flow of wash fluid to the extendable nozzle. The retractable fluid supply conduit may be in fluid communication between the valve assembly and the extendable nozzle to direct the flow of wash fluid to the extendable nozzle. At least a portion of the retractable fluid supply may extend within the enclosed conduit cavity. At least a portion of the retractable fluid supply conduit may be wound about the rotatable reel in the retracted position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
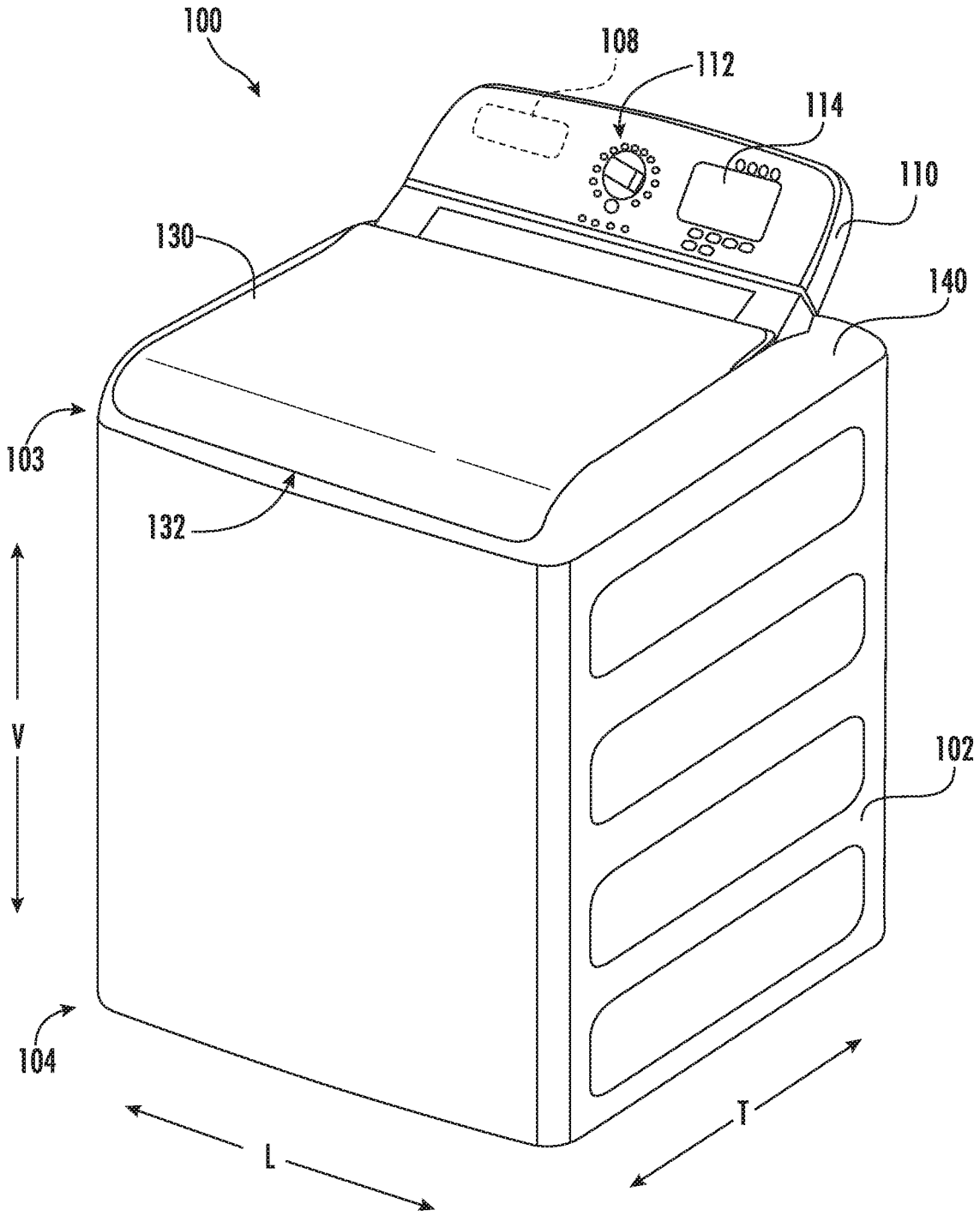
FIG. 1 provides a perspective view of a washing machine appliance according to exemplary embodiments of the present disclosure with a lid of the exemplary washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
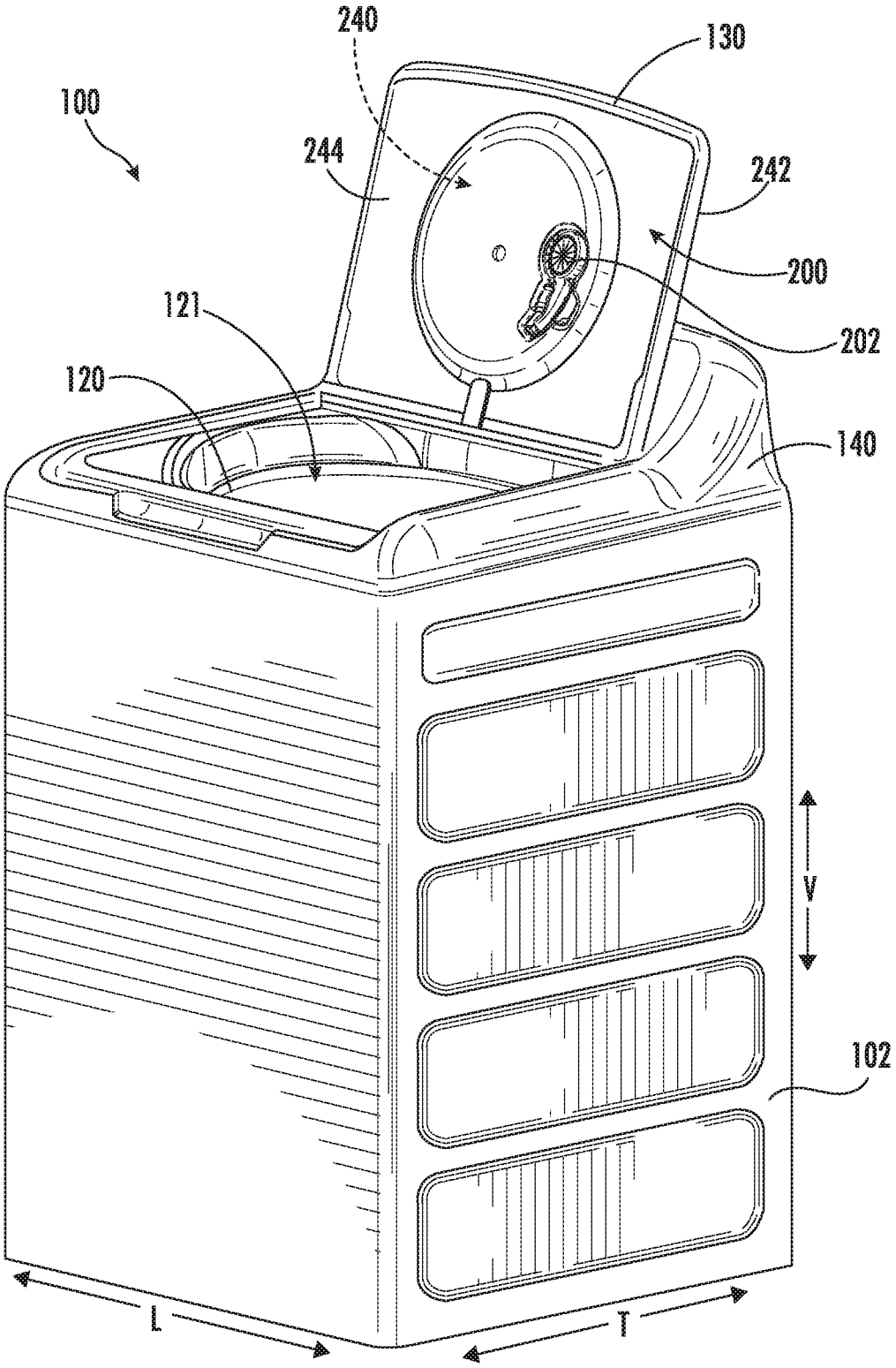
FIG. 2 provides a perspective view of the exemplary washing machine appliance of FIG. 1 with the lid of the exemplary washing machine appliance shown in an open position.
Figure 3:
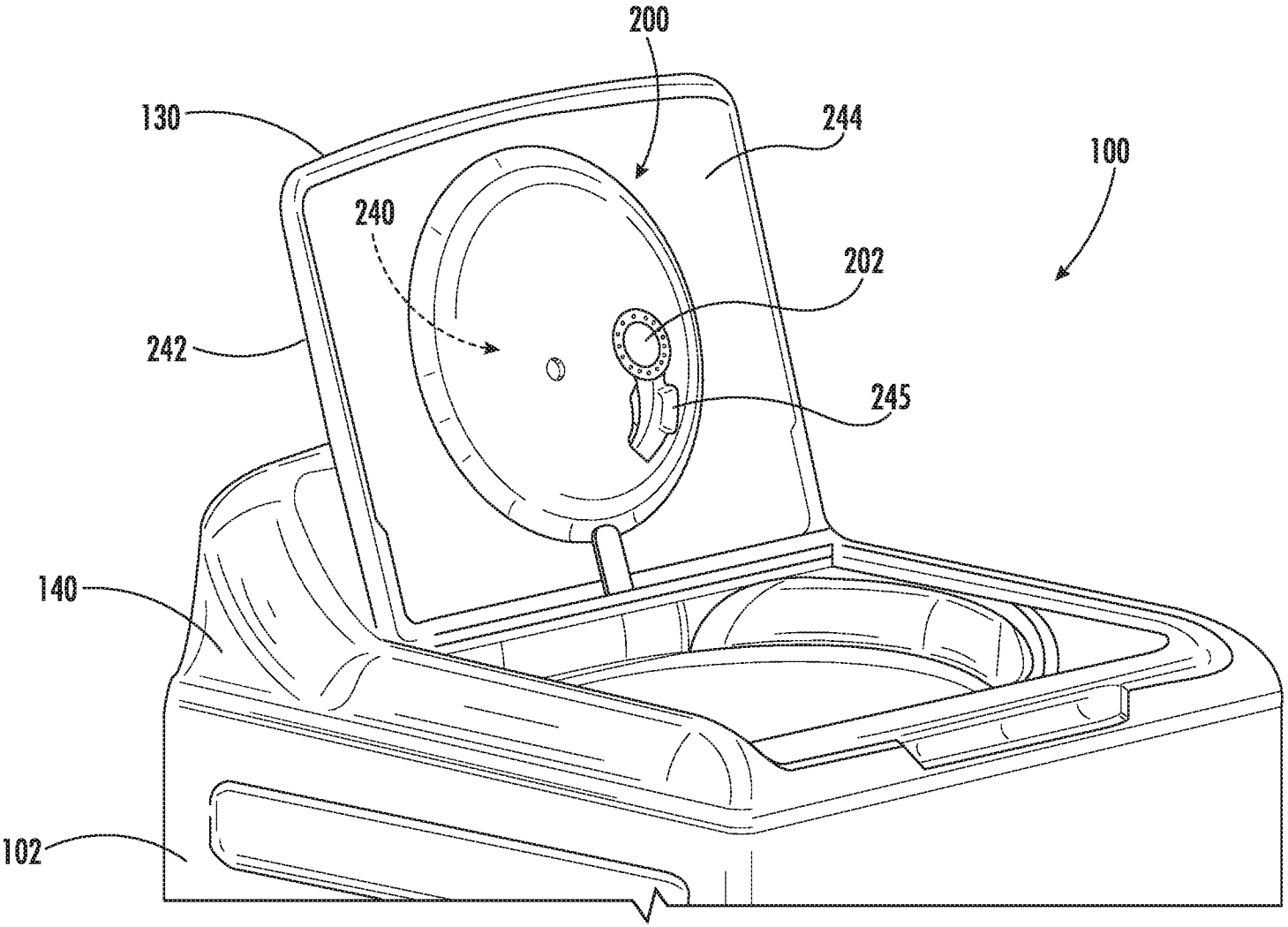
FIG. 3 provides a perspective view of a portion of the exemplary washing machine appliance of FIG. 2, including the lid and nozzle assembly.
Figure 4:
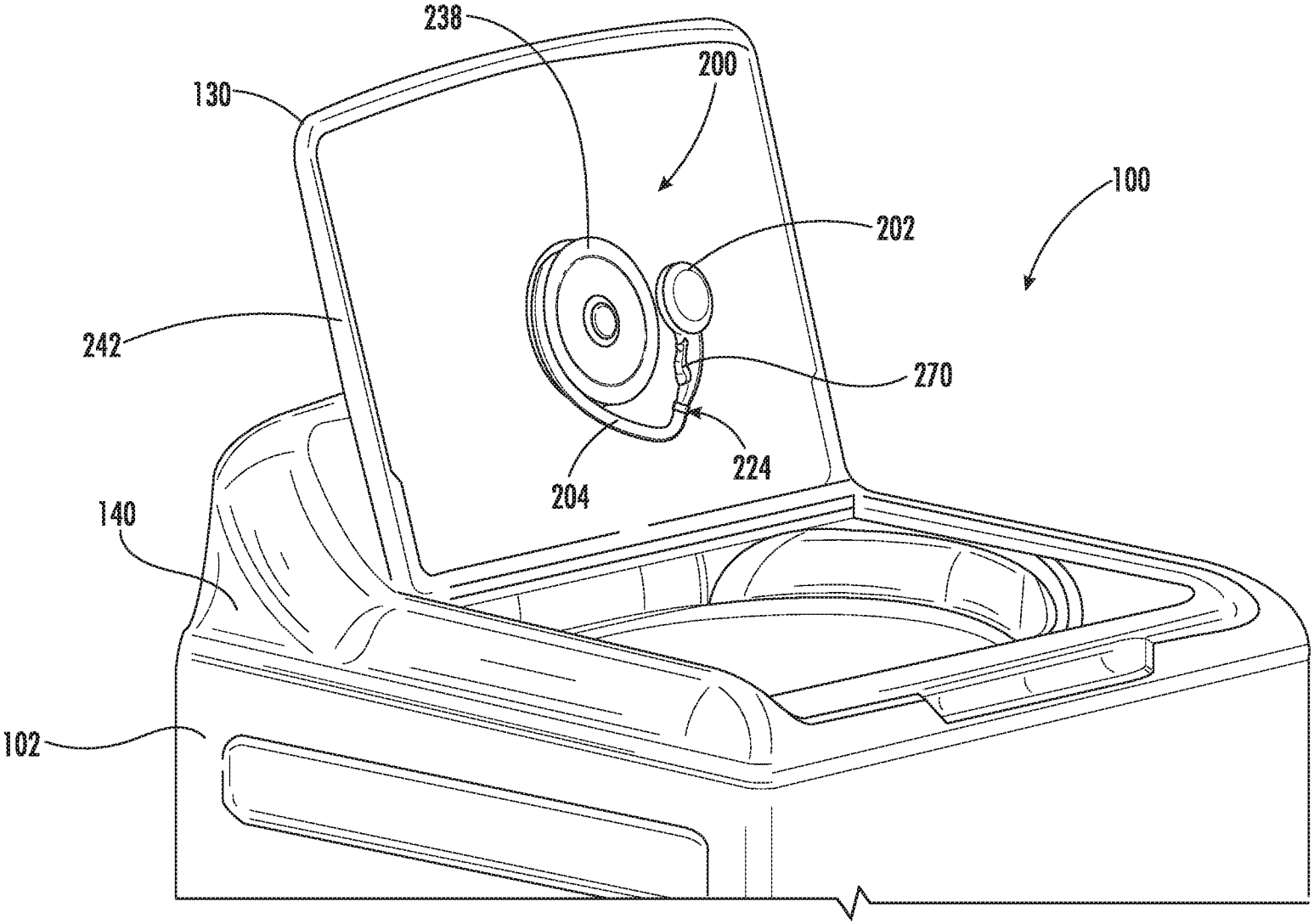
FIG. 4 provides a perspective view of a portion of the exemplary washing machine appliance of FIG. 3, wherein part of the lid has been removed for clarity.
Figure 5:
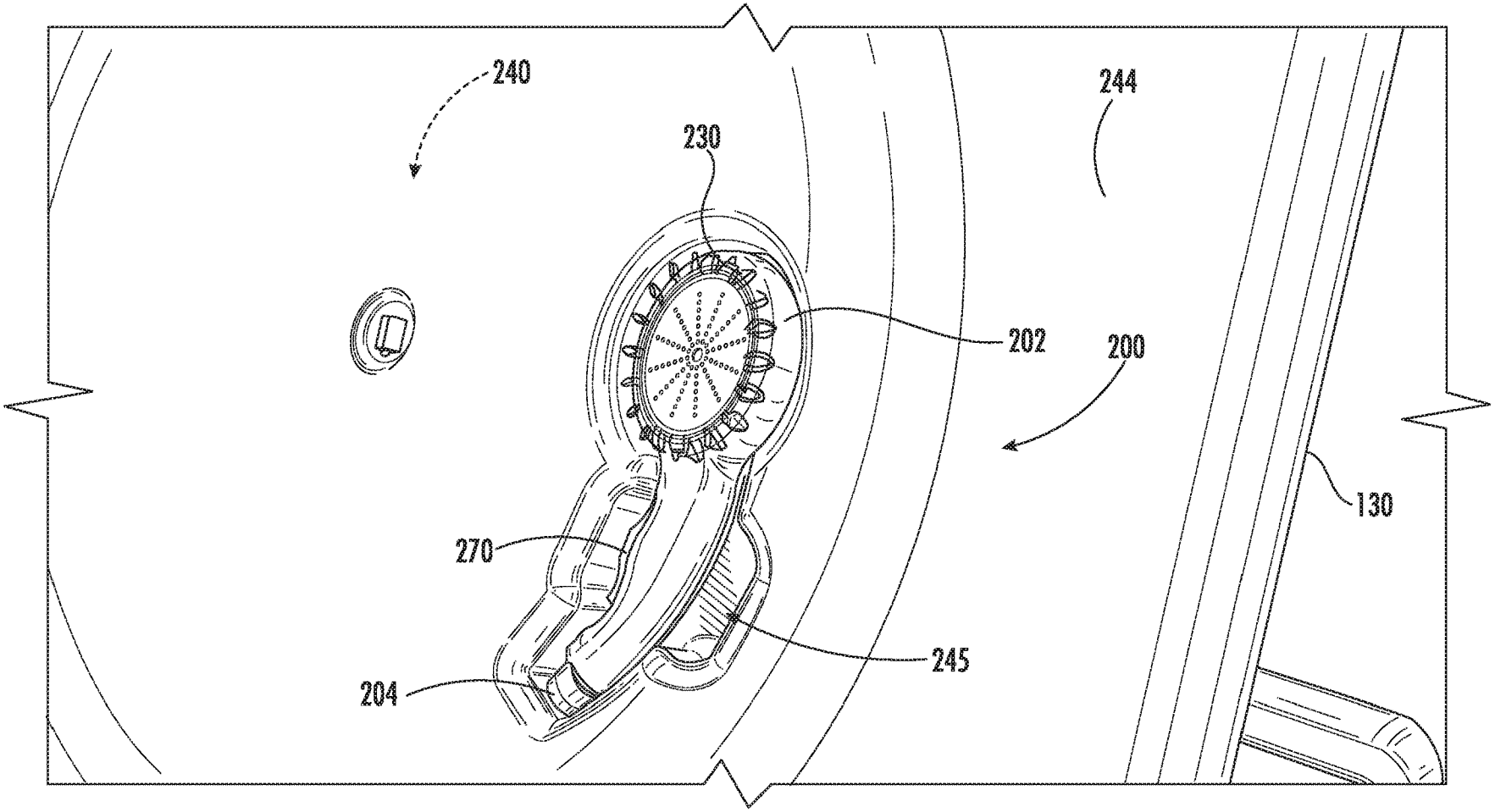
FIG. 5 provides a perspective view of a lid and nozzle assembly of a washing machine appliance according to exemplary embodiments of the present disclosure.
Figure 6:
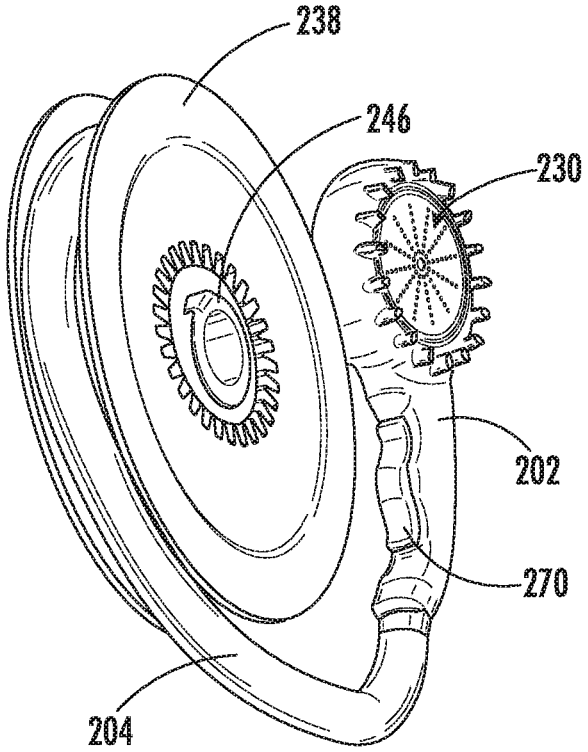
FIG. 6 provides a perspective view of a portion of the nozzle assembly of FIG. 5.
Figure 7:
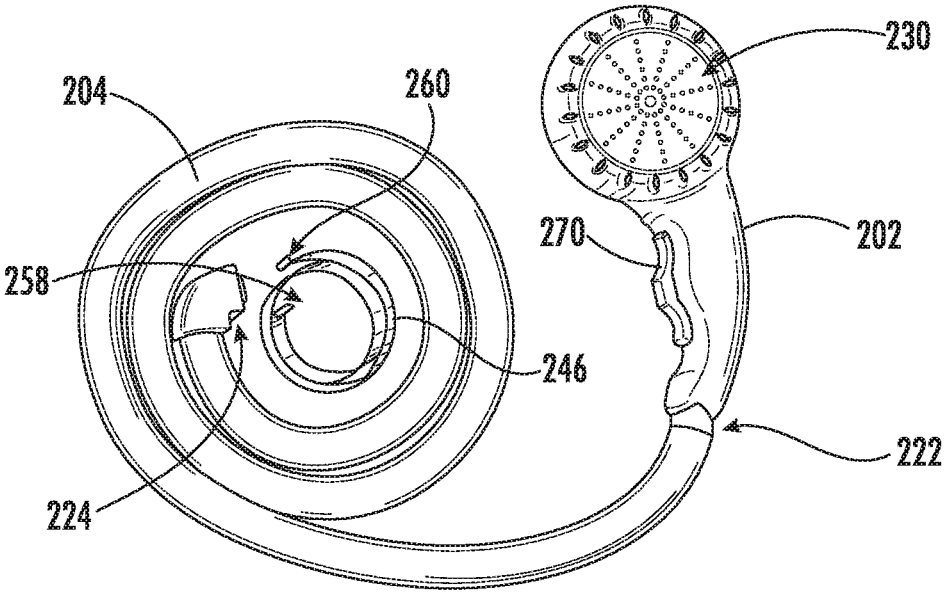
FIG. 7 provides a perspective view of a portion of the nozzle assembly of FIG. 5.

Turning now to the figures, FIGS. 1 and 2 illustrate an exemplary washing machine appliance 100. In particular appliance 100 is shown as a vertical-axis or top-loading washing machine. In FIG. 1, a door or lid 130 is shown in a closed position. In FIG. 2, lid 130 is shown in an open position. Washing machine appliance 100 generally defines a vertical direction V, a lateral direction L, and a transverse direction T, each of which is mutually perpendicular, such that an orthogonal coordinate system is generally defined.

While described in the context of a specific embodiment of top-loading washing machine appliance 100, using the teachings disclosed herein it will be understood that washing machine appliance 100 is provided by way of example only. Other washing machine appliances having different configurations, different appearances, or different features may also be utilized with the present subject matter as well. Moreover, aspects of the present subject matter may be used in any other consumer or commercial appliance where it is desirable to control the dispensing of water or another fluid.

As shown, washing machine appliance 100 has a cabinet 102 that extends between a top portion 103 and a bottom portion 104 along the vertical direction V. A wash basket 120 is rotatably mounted within cabinet 102. A motor (not shown) is in mechanical communication with wash basket 120 to selectively rotate wash basket 120 (e.g., during an agitation cycle or a rinse cycle of washing machine appliance 100). Wash basket 120 is received within a wash tub or wash chamber 121 and is configured for receipt of articles for washing. The wash tub 121 may hold wash fluids for agitation in wash basket 120 within wash tub 121. An agitator or impeller (not shown) extends into wash basket 120 and is also in mechanical communication with the motor. The impeller generally assists agitation of articles disposed within wash basket 120 and may rotate or oscillate during operation of washing machine appliance 100.

Cabinet 102 of washing machine appliance 100 generally includes a top panel 140. Top panel 140 defines an opening that permits user access to wash basket 120 of wash tub 121. In some embodiments, lid 130 is rotatably mounted to top panel 140 and permits selective access to the opening. In particular, lid 130 selectively rotates between the closed position shown in FIG. 1 and the open position shown in FIG. 2. In the closed position, lid 130 inhibits access to wash basket 120. Conversely, in the open position, a user can access wash basket 120. Lid 130 may also include a handle 132 that, for example, a user may pull or lift when opening and closing lid 130. Further, although lid 130 is illustrated as mounted to top panel 140, alternatively, lid 130 may be mounted to another portion of cabinet 102, as well as any other suitable support.

In certain embodiments, a control panel 110 with at least one input selector 112 extends from top panel 140. Control panel 110 and input selector 112 collectively form a user interface input for operator selection of machine cycles and features. A display 114 of control panel 110 indicates selected features, operation mode, a countdown timer, or other items of interest to appliance users regarding operation.

Operation of washing machine appliance 100 is generally controlled by a controller or processing device 108 that is attached to cabinet (e.g., at control panel 110) and operatively coupled (e.g., electrically coupled via one or more conductive signal lines, wirelessly coupled via one or more wireless communications bands, etc.) to portions of control panel 110 for user manipulation to select washing machine cycles and features. In response to user manipulation of control panel 110, controller 108 operates the various components of washing machine appliance 100 to execute selected machine cycles and features.

Controller 108 may include a memory (e.g., non-transitive storage media) and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 108 may be constructed without using a microprocessor, e.g., using a combination of discrete analog or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items are generally loaded into wash basket 120 through the opening of top panel 140, and a washing operation is initiated through operator manipulation of input selectors 112. Wash basket 120 is filled with a fluid, such as water and detergent or other fluid additives (e.g., via a stationary nozzle or nozzle assembly 200—described in detail below). One or more valves can be controlled by washing machine appliance 100 to provide for filling wash basket 120 to the appropriate level for the volume of articles being washed or rinsed. By way of example, for a washing cycle, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle or washing operation selected by a user. The impeller may again provide agitation within wash basket 120. One or more spin cycles also may be used. In particular, a spin cycle may be applied after the wash cycle or after the rinse cycle to wring wash fluid (e.g., water, detergent, bleach, fabric softener, or other suitable liquids, including mixtures thereof) from the articles being washed. During a spin cycle, wash basket 120 is rotated at relatively high speeds. After articles disposed in wash basket 120 are cleaned or washed, the user can remove the articles from wash basket 120 (e.g., by reaching into wash basket 120 through the opening in top panel 140).

Referring now generally to FIGS. 2 through 13, nozzle assembly 200 will be described in more detail according to various exemplary embodiments of the present disclosure. Although the discussion below refers to nozzle assembly 200, one skilled in the art will appreciate that the features and configurations described may be used for other fluid supply assemblies in other washing machine appliances as well. For example, portions of nozzle assembly 200 may be positioned in suitable alternative locations, may have a different fluid supply conduit configuration, or may dispense any suitable wash fluid or fluids. Other variations and modifications of the exemplary embodiments described below are possible, and such variations are contemplated as within the scope of the present disclosure.

As illustrated, nozzle assembly 200 includes an extendable nozzle 202 mounted to a retractable fluid supply conduit 204, at least a portion of which is mounted within lid 130. More specifically, retractable fluid supply conduit 204 extends between a first end 222 and a second end 224 and provides fluid communication between extendable nozzle 202 and a valve assembly 206. Retractable fluid supply conduit 204 is thus positioned upstream from extendable nozzle 202. In addition, valve assembly 206 is coupled to a supply of water or wash fluid and selectively provides a flow of wash fluid to extendable nozzle 202 so that a user may selectively dispense the wash fluid within wash tub 121. For example, according to the illustrated exemplary embodiments of FIG. 8, valve assembly 206 (and thus extendable nozzle 202) is directly coupled to a primary hot and cold water supply 207. Water may thus flow from the supply 207, through valve assembly 206 and retractable fluid supply conduit 204, before exiting the fluid outlet 230 defined by extendable nozzle 202.

In some embodiments, retractable fluid supply conduit 204 is movable for positioning extendable nozzle 202 in a retracted position and an extended position. In the retracted position, extendable nozzle 202 is held on lid 130. Thus, extendable nozzle 202 may be selectively attached to lid 130 and move therewith (e.g., as lid 130 pivot between the open position and a closed position). By contrast, in the extended position, extendable nozzle 202 may be spaced apart from lid 130 (e.g., as illustrated by phantom lines in FIG. 8). Specifically, extendable nozzle 202 may be movable relative to, and thus not directly fixed relative to, lid 130. Extendable nozzle 202 may be further movable relative to cabinet 102 such that a user may freely direct and change the aim of extendable nozzle 202 (e.g., into wash tub 121).

Figure 8:
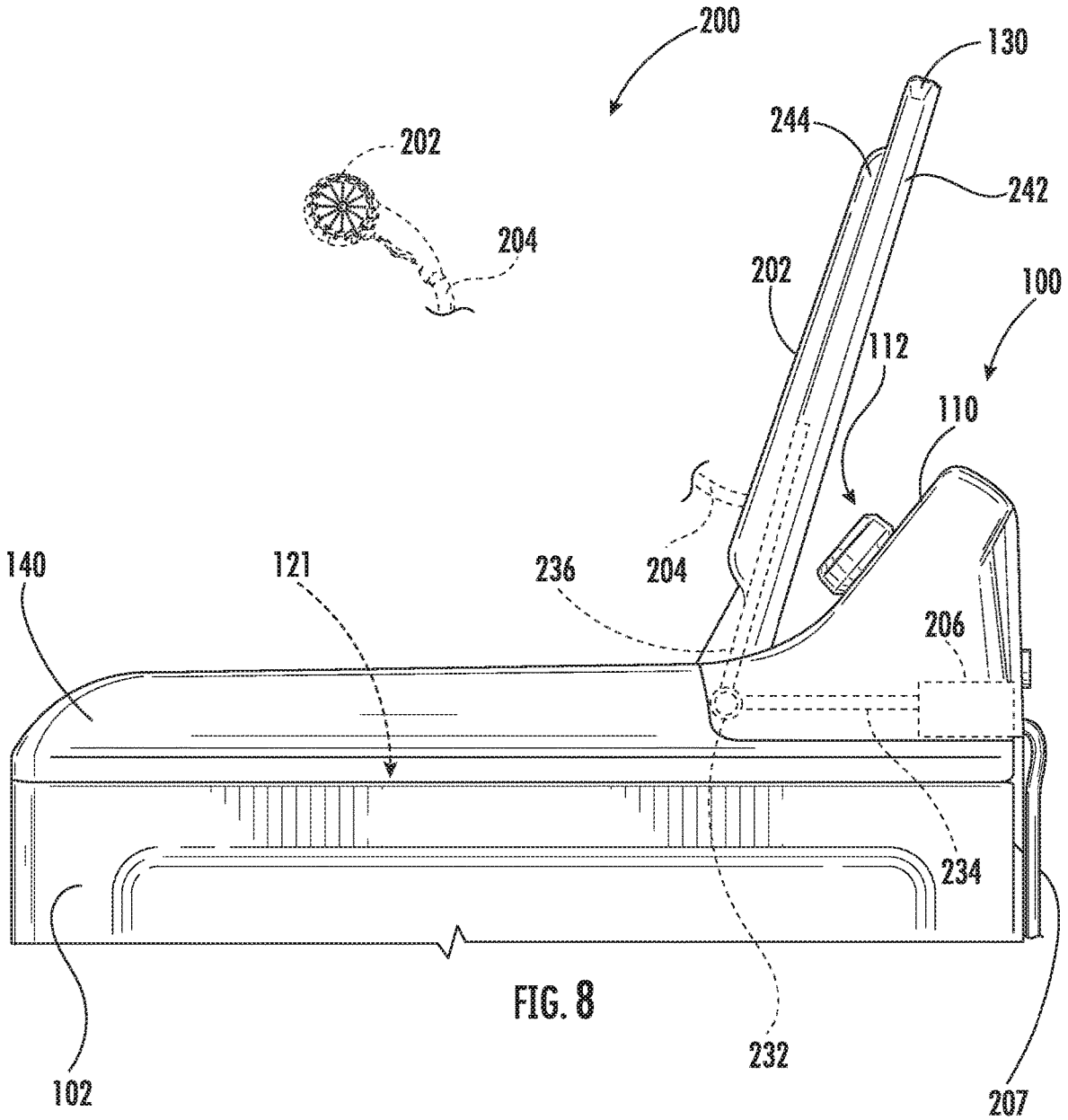
FIG. 8 provides a side perspective view of the exemplary nozzle assembly of FIG. 5 shown in an extended position.
Figure 9:
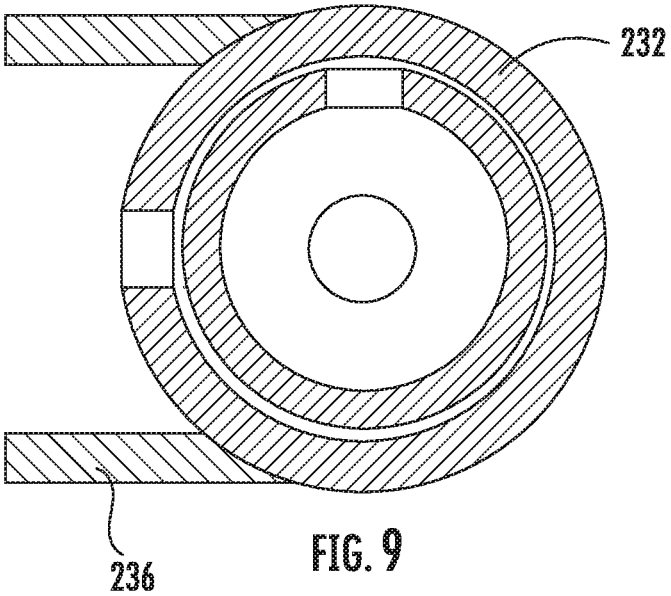
FIG. 9 provides a side, schematic view of an intermediate valve of a nozzle assembly according to exemplary embodiments of the present disclosure, the intermediate valve being in a sealed position.
Figure 10:
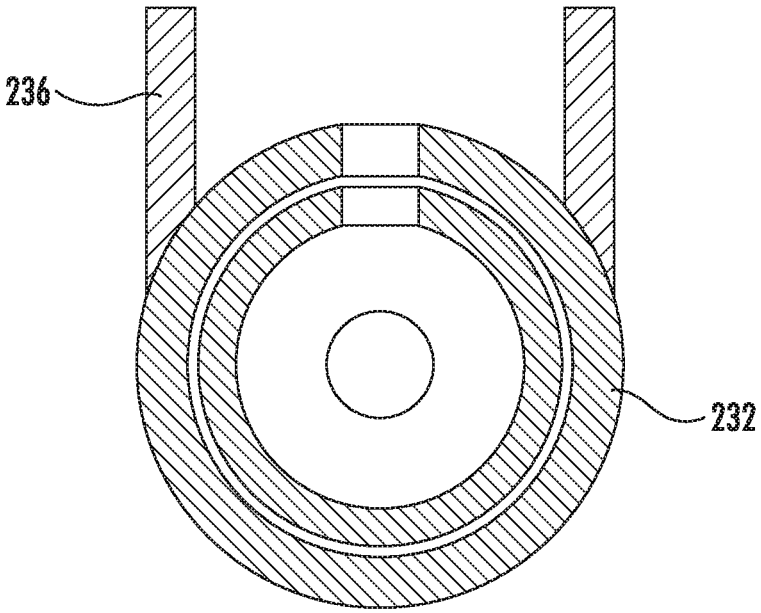
FIG. 10 provides a side, schematic view of the exemplary intermediate valve of FIG. 9 in an unsealed position.

Turning especially to FIGS. 8 through 10, in some embodiments, an intermediate valve 232 is further provided in fluid communication between valve assembly 206 and retractable fluid supply conduit 204. Generally, intermediate valve 232 may restrict or permit water from valve assembly 206 to retractable fluid supply conduit 204 based on the position of the lid 130. For instance, intermediate valve 232 may be provided as a suitable rotating valve (e.g., two-port valve, such as a ball valve) between two conduit segments (i.e., one upstream segment 234 and one downstream segment 236). Intermediate valve 232 is movable between at least a sealed position (e.g., FIG. 9) that prevents the flow of wash fluid through the intermediate valve 232 and an unsealed position that (FIG. 10). In some embodiments, the sealed position corresponds to the closed position of the lid 130 and the unsealed position corresponds to the open position of intermediate valve 232. Thus, movement of lid 130 to the open position or closed position may similarly move intermediate valve 232 to the unsealed position or sealed position, respectively. Optionally, upstream segment 234 may be non-rotatable while downstream segment 236 is rotationally fixed to lid 130 (e.g., to rotate therewith). Lid 130 may thus similarly rotate upstream segment 234 and move intermediate valve 232 between the unsealed position and sealed position. Advantageously, wash fluid flow from the extendable nozzle 202 may be prevented when a user is unable to access extendable nozzle 202 or otherwise freely direct extendable nozzle 202 within wash tub 121.

Returning generally to FIGS. 2 through 13, retractable fluid supply conduit 204 may be wrapped or selectively wound about a suitable reel 238. For instance, a rotatable reel 238 may be mounted (e.g., rotatably mounted) on lid 130. The length or amount of retractable fluid supply conduit 204 that is wound about reel 238 may vary between the retracted position and the extended position. In the retracted position, retractable fluid supply conduit 204 is wound on lid 130. In the extended position, at least a portion of retractable fluid supply conduit 204 (or a greater portion than would be found in the retracted position) is unwound or uncoiled from lid 130. Advantageously, the selective winding retractable fluid supply conduit 204 may assist in managing relatively long length retractable fluid supply conduit 204, while permitting free movement of extendable nozzle 202 relative to lid 130. Additionally or alternatively, selective winding on lid 130 may permit greater length of retractable fluid supply conduit 204 than would be possible or practical on another portion of cabinet 102 (e.g., without significantly reducing the usable volume of wash tub 121 or increasing the overall volume of cabinet 102).

In some situations, a user may wish to add additional water to wash tub 121 or add a particular wash fluid for a pretreat operation. For example, a user may wish to prewash one or more articles of clothing or may perceive that more water is needed to effectively wash a load. In order to provide a user with control over the flow of wash fluid being dispensed through extendable nozzle 202, nozzle assembly 200 may further include one or more user input buttons 270 for adding a wash fluid to wash tub 121. User input buttons 270 may be operably coupled with controller 108 or valve assembly 206 for controlling the flow of wash fluid. Additionally or alternatively, a user input button 270 may be mechanically coupled to a valve within the body of extendable nozzle 202 for selective actuation (e.g., opening or closing) of the valve. According to the illustrated embodiment, user input button 270 is located on extendable nozzle 202 for easy access by an operator. However, according to alternative embodiments, user input button 270 may be positioned at any other suitable location.

In certain embodiments, lid 130 defines an enclosed cavity 240 within which at least a portion of retractable fluid supply conduit 204 is housed. For instance, lid 130 may include a primary shell 242 and the secondary shell 244 attached to primary shell 242. In some such embodiments, primary shell 242 includes a substantially planar body, while secondary shell 244 includes a concave body complementary to the wound volume of retractable fluid supply conduit 204. The concave body of secondary shell 244 may be mated or fixed the planar body primary shell 242 such that enclosed cavity 240 is formed or defined between them. At least a portion of reel 238 may be housed within enclosed cavity 240. An opening or aperture for retractable fluid supply conduit 204 may be defined through lid 130 (e.g., through secondary shell 244) to permit retractable fluid supply conduit 204 to pass into and out of enclosed cavity 240. As extendable nozzle 202 is moved between the retracted position and extended position, retractable fluid supply conduit 204 may be simultaneously moved between (e.g., into or out of) enclosed cavity 240.

Figure 13:
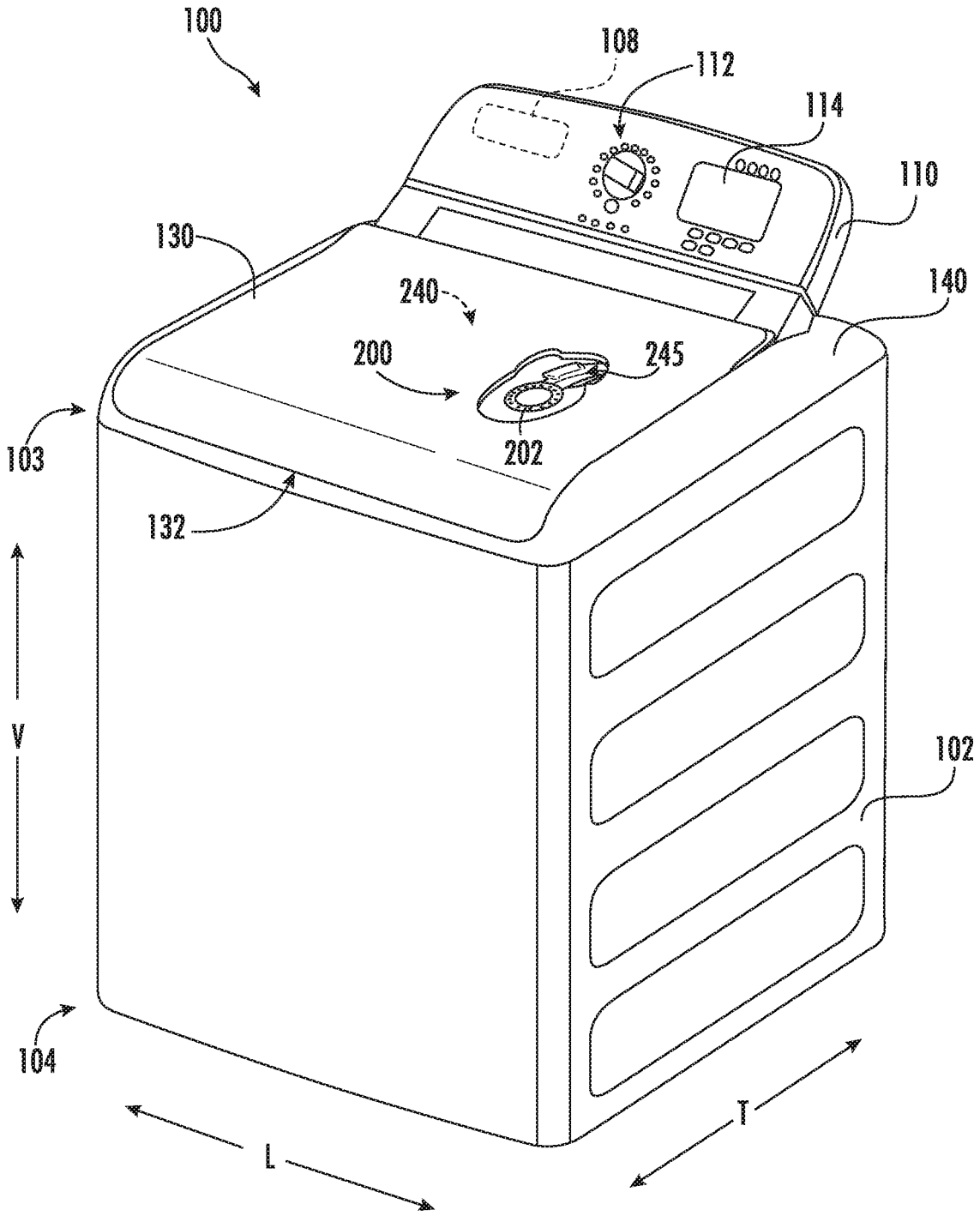
FIG. 13 provides a perspective view of a washing machine appliance according to other exemplary embodiments of the present disclosure with a lid of the exemplary washing machine appliance shown in a closed position.

As shown, for instance in FIGS. 2, 3, 5, and 13 exemplary embodiments of lid 130 define an open dock recess 245 within which extendable nozzle 202 may be held (e.g., when extendable nozzle 202 is in the retracted position). In some such embodiments, open dock recess 245 forms a complementary void on secondary shell 244 that extendable nozzle 202 fits within (e.g., in a frictional fit engagement). The void of the open dock recess 245 may be generally downstream of enclosed cavity 240 such that retractable fluid supply conduit 204 may extend from enclosed cavity 240, through a wall of secondary shell 244, and to the open dock recess 245. The open dock recess 245 may be formed on the bottom side of lid 130 or, alternatively, on the top side of lid 130. For instance, as illustrated in FIG. 2, open dock recess 245 may be directed toward wash tub, thereby permitting access to open dock recess 245 when lid 130 is lifted (e.g., in the open position). Alternatively, as shown in FIG. 13, open dock recess 245 may be directed above wash tub, thereby permitting access to open dock recess 245 when lid 130 is not lifted (e.g., in the closed position).

Figure 11:
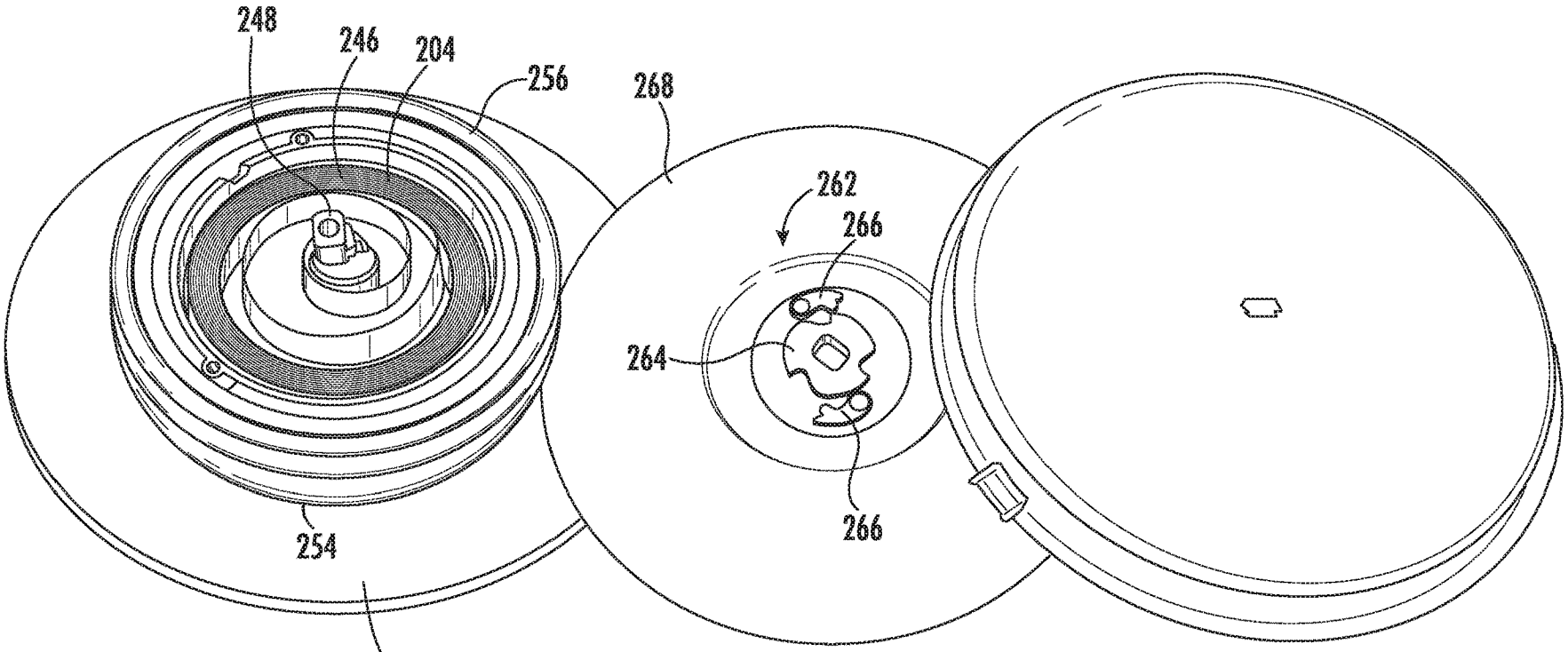
FIG. 11 provides an exploded perspective view of a portion of a nozzle assembly according to exemplary embodiments of the present disclosure.
Figure 12:
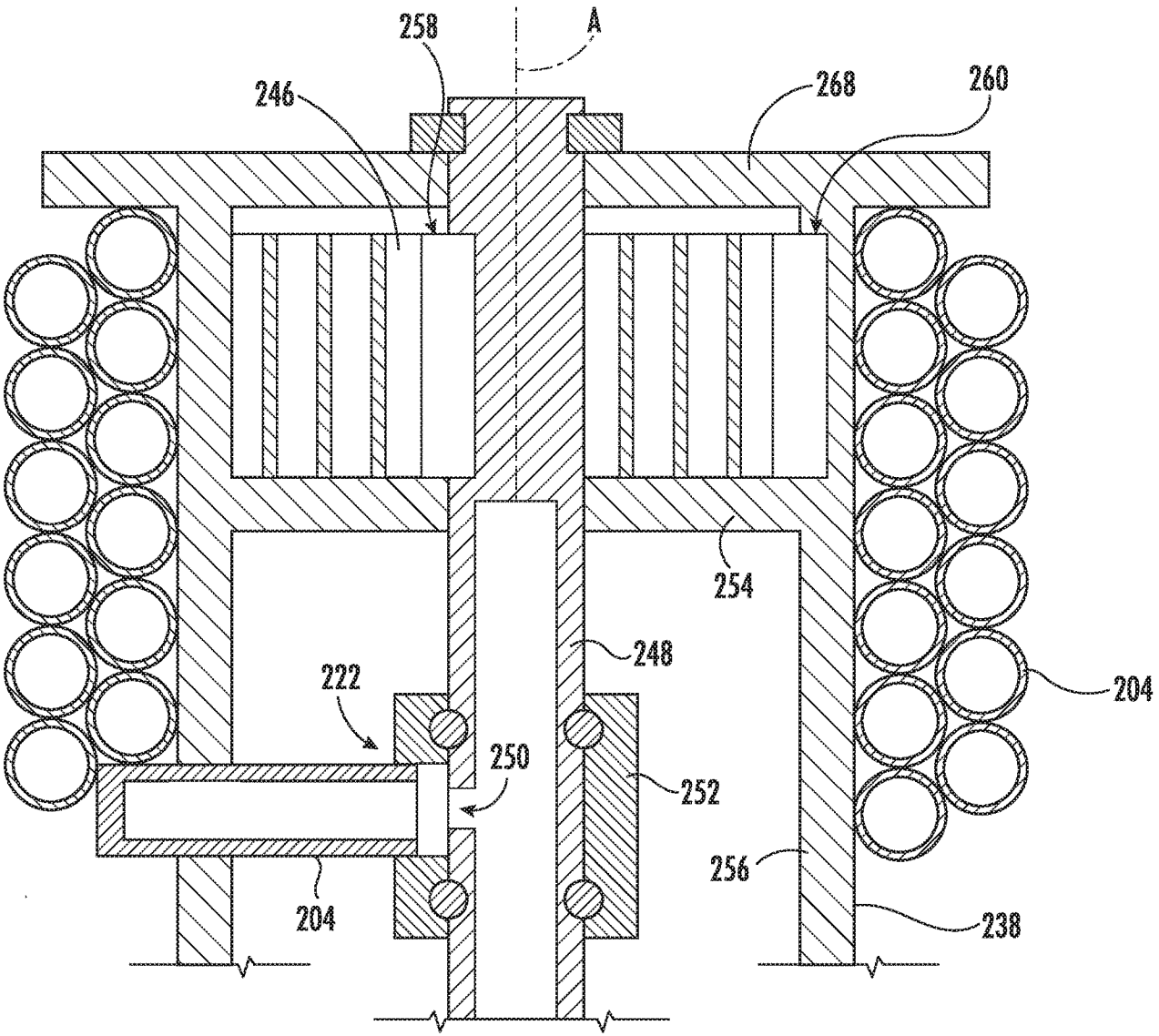
FIG. 12 provides a cross-sectional schematic view of a portion of a nozzle assembly according to exemplary embodiments of the present disclosure.

Turning especially to FIGS. 11 and 12, in additional or alternative embodiments, a biasing element, such as a torsion spring 246, is mounted on lid 130 (e.g., within lid 130 or enclosed cavity 240). For instance, torsion spring 246 may be included with reel 238 and generally bias retractable fluid supply conduit 204 to the retracted position. In some such embodiments, reel 238 is rotatably mounted to a spigot 248 defining a rotation axis A. Spigot 248 defines a radial outlet 250 positioned downstream of valve assembly 206 and upstream of fluid supply conduit 204. A rotating fluid collar 252 may extend (e.g., circumferentially) about spigot 248 at the radial outlet 250 and fluidly connect retractable fluid supply conduit 204 to the same. An internal wall 254 may extend radially from spigot 248 (e.g., at an axial location above radial outlet 250) to an outer wall 256 (e.g., circumferential wall) on which retractable fluid conduit is wound. One end 258 of torsion spring 246 may be fixed or attached to spigot 248 while the other end 260 of torsion spring 246 is fixed or attached to outer wall 256. Rotation of outer wall 256 about spigot 248 in one rotational direction (e.g., clockwise or counterclockwise), such as when retractable fluid supply conduit 204 is moved to the extended position, may cause torsion spring 246 to unfurl. By contrast, rotation of outer wall 256 about spigot 248 in the opposite direction (e.g., counterclockwise or clockwise), such as when retractable fluid supply conduit 204 is moved to the retracted position, may cause torsion spring 246 to contract.

In further additional or alternative embodiments, a ratcheting assembly 262 is provided on rotatable reel 238. Specifically, a complementary ratchet gear 264 and one or more pawls 266 may be provided in selective ratcheting engagement about the rotation axis A. In some embodiments, an upper wall 268 is positioned on rotatable reel 238 (e.g., such that the wound rotatable fluid supply conduit 204 is axially positioned between upper wall 268 and an internal surface of lid 130). Moreover, upper wall 268 may be rotationally fixed relative to rotatable reel 238 such that upper wall 268 rotates with rotatable reel 238 about rotation axis A. Ratchet gear 264 may be rotationally fixed relative to spigot 248 such that ratchet gear 264 remains in a predetermined rotational position as reel 238 rotates about rotation axis A. Optionally, a pawl 266 may be pivotably attached to upper wall 268 and radially spaced apart from spigot 248 to selectively engage the teeth of ratchet gear 264. For instance, a pair of pawls 266 at opposite circumferential positions about ratchet gear 264 may be alternately biased towards ratchet gear 264 (e.g., by a suitable biasing spring or gravity, such as when lid 130 is in the open position). When assembled, rotation of reel 238 to the extended position is thus permitted and counter rotation to the retracted position is restricted. Lifting of the pawl 266 from the ratchet gear 264 may permit counter rotation to the retracted position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet;

a tub positioned within the cabinet;

a wash basket rotatably mounted within the tub, the wash basket defining a wash chamber for receiving articles for washing;

a lid rotatably mounted to the cabinet above the wash basket to move between an open position permitting access to the wash chamber and closed position restricting access to the wash chamber, the lid comprising a mutually fixed primary shell and secondary shell defining an enclosed cavity therebetween, the mutually fixed primary shell and secondary shell being simultaneously movable between the open position and the closed position; and a nozzle assembly mounted in part within the lid and configured to provide a liquid to the tub, the nozzle assembly comprising an extendable nozzle movable between a retracted position at which the extendable nozzle is held on the lid and an extended position in which the extendable nozzle is spaced apart from the lid in the open position, a retractable fluid supply conduit upstream of the extendable nozzle, the retractable fluid supply conduit being selectively wound and housed within the enclosed cavity in the retracted position between the mutually fixed primary shell and secondary shell, a valve assembly mounted within the cabinet, the valve assembly being positioned upstream of the retractable fluid supply conduit and configured to provide a flow of wash fluid to the extendable nozzle, and an intermediate valve positioned in fluid communication between the valve assembly and the retractable fluid supply, wherein an aperture is defined through the secondary shell in communication with the enclosed cavity to permit the retractable fluid supply conduit to pass thereto, wherein the intermediate valve is movable between a sealed position and an unsealed position, wherein the sealed position corresponds to the closed position of the lid and prevents the flow of wash fluid through the intermediate valve, wherein the unsealed position corresponds to the open position of the lid and permits the flow of wash fluid through the intermediate valve, and wherein the lid defines an enclosed conduit cavity, and wherein at least a portion of the retractable fluid supply conduit is housed within the enclosed conduit cavity.

2. The washing machine appliance of claim 1, further comprising a rotatable reel about which at least a portion of the retractable fluid supply conduit is wound in the retracted position.

3. The washing machine appliance of claim 2, further comprising a torsion spring positioned within the lid and biasing the rotatable reel to the retracted position.

4. The washing machine appliance of claim 2, further comprising a ratchet gear and a pawl in selective ratcheting engagement about a rotation axis of the rotatable reel.

5. The washing machine appliance of claim 1, wherein the lid defines an open dock recess, and wherein the extendable nozzle is held within the open dock recess in the retracted position.

6. The washing machine appliance of claim 5, wherein the open dock recess is directed toward the tub to permit access to the open dock recess in the open position of the lid.

7. The washing machine appliance of claim 5, wherein the open dock recess is directed above the tub to permit access to the open dock recess in the closed position of the lid.

8. The washing machine appliance of claim 1, wherein the nozzle assembly comprises a user input button located on the extendable nozzle for selectively adding a wash fluid to the tub.

9. A washing machine appliance comprising:

a cabinet;

a tub positioned within the cabinet;

a wash basket rotatably mounted within the tub, the wash basket defining a wash chamber for receiving articles for washing;

a lid rotatably mounted to the cabinet above the wash basket to move between an open position permitting access to the wash chamber and closed position restricting access to the wash chamber, the lid comprising a mutually fixed primary shell and secondary shell defining an enclosed conduit cavity therebetween, the mutually fixed primary shell and secondary shell being simultaneously movable between the open position and the closed position; and a nozzle assembly configured to provide a liquid to the tub, the nozzle assembly comprising an extendable nozzle movable between a retracted position at which the extendable nozzle is held on the lid and an extended position in which the extendable nozzle is spaced apart from the lid in the open position, a valve assembly mounted within the cabinet and configured to provide a flow of wash fluid to the extendable nozzle, a retractable fluid supply conduit in fluid communication between the valve assembly and the extendable nozzle to direct the flow of wash fluid to the extendable nozzle, at least a portion of the retractable fluid supply being selectively wound and housed within the enclosed conduit cavity between the mutually fixed primary shell and secondary shell, a rotatable reel mounted within the enclosed cavity and about which at least a portion of the retractable fluid supply conduit is wound in the retracted position, and an intermediate valve positioned in fluid communication between the valve assembly and the retractable fluid supply, wherein an aperture is defined through the secondary shell in communication with the enclosed cavity to permit the retractable fluid supply conduit to pass thereto, wherein the intermediate valve is movable between a sealed position and an unsealed position, wherein the sealed position corresponds to the closed position of the lid and prevents the flow of wash fluid through the intermediate valve, and wherein the unsealed position corresponds to the open position of the lid and permits the flow of wash fluid through the intermediate valve, and wherein the lid defines an enclosed conduit cavity.

10. The washing machine appliance of claim 9, further comprising a torsion spring positioned within the lid and biasing the rotatable reel to the retracted position.

11. The washing machine appliance of claim 9, further comprising a ratchet gear and a pawl in selective ratcheting engagement about a rotation axis of the rotatable reel.

12. The washing machine appliance of claim 9, wherein the lid defines an open dock recess, and wherein the extendable nozzle is held within the open dock recess in the retracted position.

13. The washing machine appliance of claim 12, wherein the open dock recess is directed toward the tub to permit access to the open dock recess in the open position of the lid.

14. The washing machine appliance of claim 12, wherein the open dock recess is directed above the tub to permit access to the open dock recess in the closed position of the lid.

15. The washing machine appliance of claim 9, wherein the nozzle assembly comprises a user input button located on the extendable nozzle for selectively adding a wash fluid to the tub.

* * * * *